US009852564B2

(12) United States Patent
Henderson

(10) Patent No.: US 9,852,564 B2
(45) Date of Patent: Dec. 26, 2017

(54) ELECTRONIC DOOR LOCKS, SYSTEMS, AND NETWORKS

(71) Applicant: STRATTEC ADVANCED LOGIC, LLC, Milwaukee, WI (US)

(72) Inventor: Kevin Henderson, Davenport, FL (US)

(73) Assignee: STRATTEC ADVANCED LOGIC, LLC, Milwaukee, WI (US)

( * ) Notice: Subject to any disclaimer, the term of this patent is extended or adjusted under 35 U.S.C. 154(b) by 0 days.

(21) Appl. No.: 14/584,739

(22) Filed: Dec. 29, 2014

(65) Prior Publication Data

US 2016/0145899 A1 May 26, 2016

Related U.S. Application Data

(60) Provisional application No. 62/085,007, filed on Nov. 26, 2014.

(51) Int. Cl.

| | |
|---|---|
| ***G07C 9/00*** | (2006.01) |
| *E05B 39/04* | (2006.01) |
| *E05B 35/00* | (2006.01) |
| *E05B 47/00* | (2006.01) |

(52) U.S. Cl.

CPC ..... *G07C 9/00563* (2013.01); *E05B 39/04* (2013.01); *E05B 2035/009* (2013.01); *E05B 2047/0095* (2013.01)

(58) Field of Classification Search

CPC ..... G07C 9/00904; G07C 2009/00333; G07C 9/00563

USPC ..... 340/5.53, 4.42

See application file for complete search history.

(56) References Cited

U.S. PATENT DOCUMENTS

| | | | | |
|---|---|---|---|---|
| 2010/0307206 | A1* | 12/2010 | Taylor | G07C 9/00309 70/91 |
| 2011/0084831 | A1* | 4/2011 | Tran | G07C 9/00309 340/539.1 |
| 2011/0210816 | A1* | 9/2011 | Wang | H04L 63/0428 340/3.71 |

* cited by examiner

*Primary Examiner* — Qutbuddin Ghulamali

(74) *Attorney, Agent, or Firm* — Michael Best & Friedrich LLP

(57) ABSTRACT

Electronic locks, electronic lock systems, and electronic lock networks are provided, and can include a latch, an interior unit including an interior handle operable to place the latch in the unlatched position, an interior user-interface, and an interior controller coupled to the interior user-interface; an exterior unit including an exterior handle having an active mode and a non-active mode, the exterior handle operable to place the latch in the unlatched position when in the active mode, an exterior user-interface, a fingerprint sensor configured to sense fingerprint data, and an exterior controller configure to receive the sensed fingerprint data, output the sensed fingerprint data, and place the exterior handle in the active mode upon receiving an active signal; and a main controller coupled to the interior controller and the exterior controller, the main controller configured to receive the sensed fingerprint data from the exterior controller, compare the sensed fingerprint data to a known fingerprint data, and output the active signal to the exterior controller based on the comparison.

21 Claims, 14 Drawing Sheets

ELECTRONIC DOOR LOCKS, SYSTEMS, AND NETWORKS

RELATED APPLICATIONS

The present application claims priority to U.S. Provisional Application 62/085,007, filed Nov. 26, 2014, the entire contents of which are incorporated herein by reference.

BACKGROUND

The present invention relates to electronic door lock systems and methods.

SUMMARY

Some embodiments of the present invention provide an electronic door lock system comprising a latch having a latched position and an unlatched position; an interior unit including an interior handle operable to place the latch in the unlatched position, an interior user-interface, and an interior controller communicatively coupled to the interior user-interface; an exterior unit including an exterior handle having an active mode and a non-active mode, the exterior handle operable to place the latch in the unlatched position when in the active mode, an exterior user-interface, a fingerprint sensor configured to sense fingerprint data, and an exterior controller configure to receive the sensed fingerprint data, output the sensed fingerprint data, and place the exterior handle in the active mode upon receiving an active signal; and a main controller communicatively coupled to the interior controller and the exterior controller, the main controller configured to receive the sensed fingerprint data from the exterior controller, compare the sensed fingerprint data to a known fingerprint data, and output the active signal to the exterior controller based on the comparison.

In some embodiments, an electronic door lock system is provided, and comprises a latch having a latched position and an unlatched position; an interior unit including an interior handle operable to place the latch in the unlatched position, and an interior user-interface having an interior display; an exterior unit including an exterior handle having an active mode and a non-active mode, the exterior handle operable to place the latch in the unlatched position when in the active mode, an exterior user-interface having an exterior display, a fingerprint sensor configured to sense fingerprint data and output the sensed fingerprint data; and a main controller communicatively coupled to the interior unit and the exterior unit, the main controller configured to receive the sensed fingerprint data, compare the sensed fingerprint data to a known fingerprint data, and place the exterior handle in the active mode based on the comparison.

Some embodiments of the present invention provide an electronic door lock system comprising a latch having a latched position and an unlatched position; an interior unit including an interior handle operable to place the latch in the unlatched position, and an interior user-interface having an interior display; an exterior unit including an exterior handle having an active mode and a non-active mode, the exterior handle operable to place the latch in the unlatched position when in the active mode, an exterior user-interface having an exterior display, a fingerprint sensor configured to sense fingerprint data and output the sensed fingerprint data; a wireless power supply module; a wireless network communications module; and a main controller communicatively coupled to the interior unit, the exterior unit, the wireless power supply module, and the wireless network communications module, the main controller configured to receive the sensed fingerprint data, compare the sensed fingerprint data to a known fingerprint data, and place the exterior handle in the active mode based on the comparison.

In some embodiments, an electronic lock network is provided, and comprises a plurality of lock systems each including a latch having a latched position and an unlatched position, an interior unit including an interior handle operable to place the latch in the unlatched position, an exterior unit including an exterior handle having an active mode and a non-active mode, the exterior handle operable to place the latch in the unlatched position when in the active mode, and a fingerprint sensor configured to sense fingerprint data and output the sensed fingerprint data, a wireless power supply, a wireless network communications module, and a controller communicatively coupled to the wireless power supply and the wireless network communication module, the main controller configured to receive the sensed fingerprint data, compare the sensed fingerprint data to a known fingerprint data, and place the exterior handle in the active mode based on the comparison; and an external computer including a second wireless network communications module, the external computer configured to send the known fingerprint data to at least one of the plurality of lock systems over a wireless mesh network comprising the plurality of lock systems.

DETAILED DESCRIPTION

Figure 1:
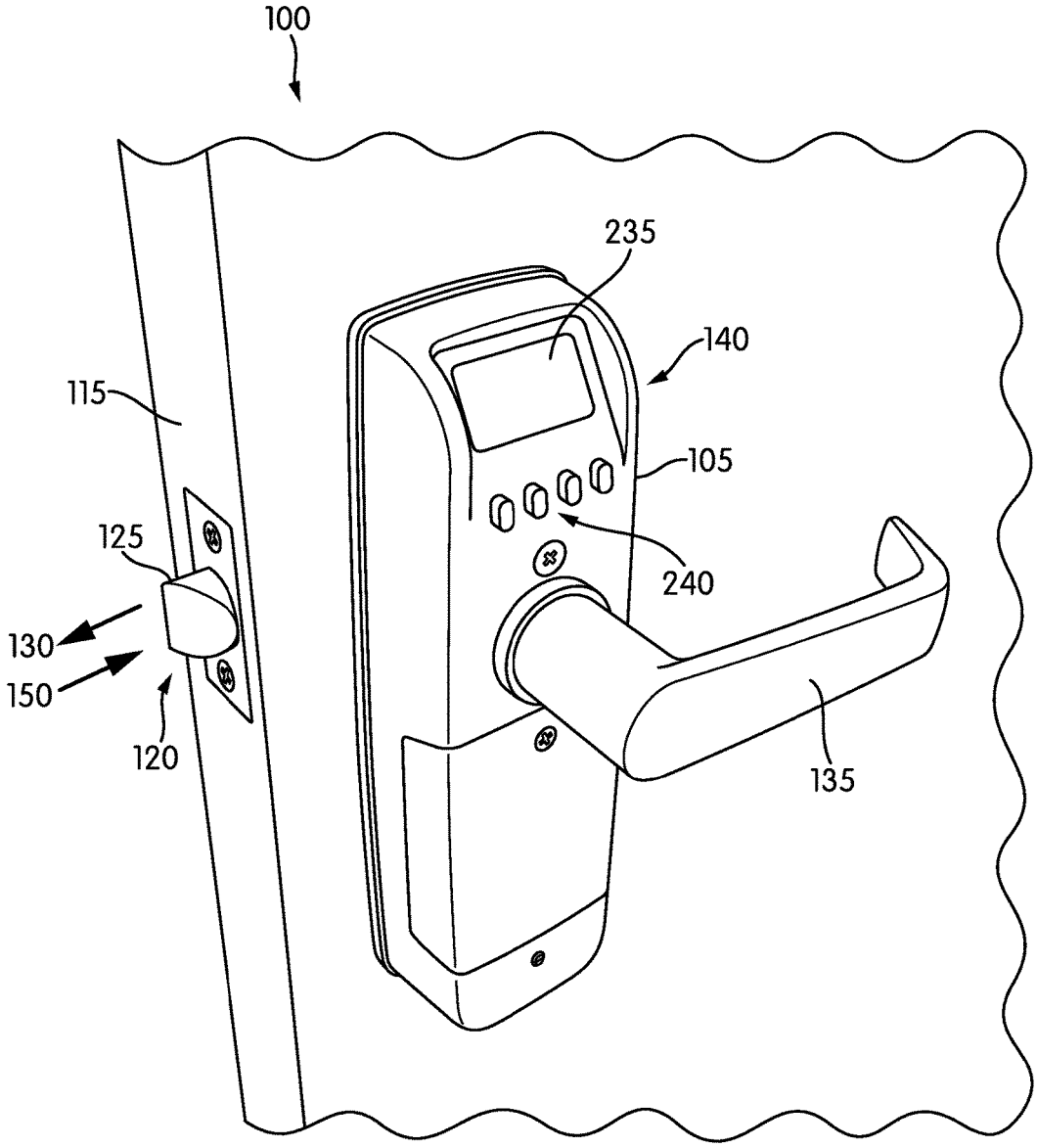
FIG. 1 is a perspective view of an interior portion of a lock system according to one embodiment of the invention.
Figure 2:
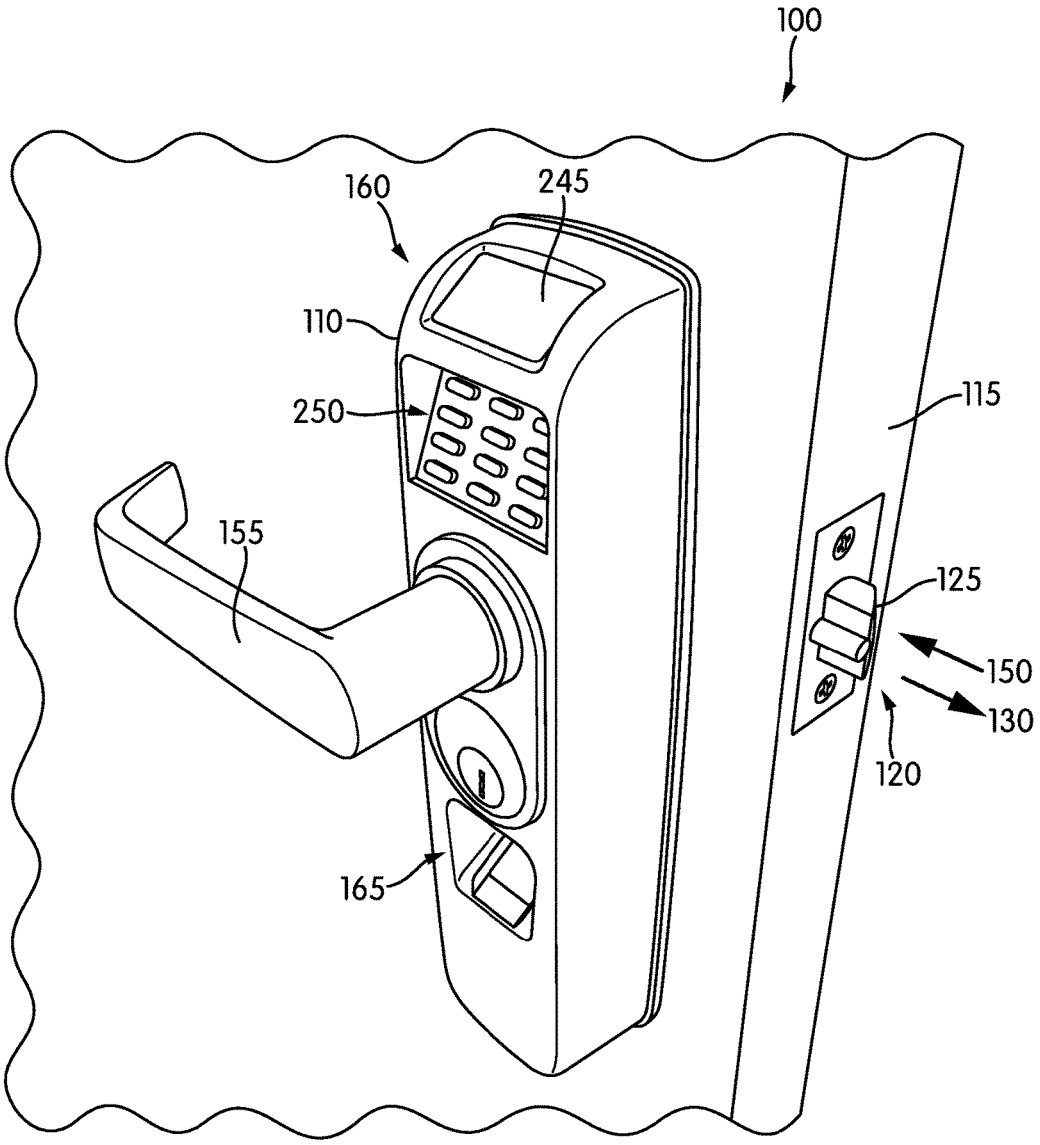
FIG. 2 is a perspective view of an exterior portion of the lock system of FIG. 1.
Figure 3:
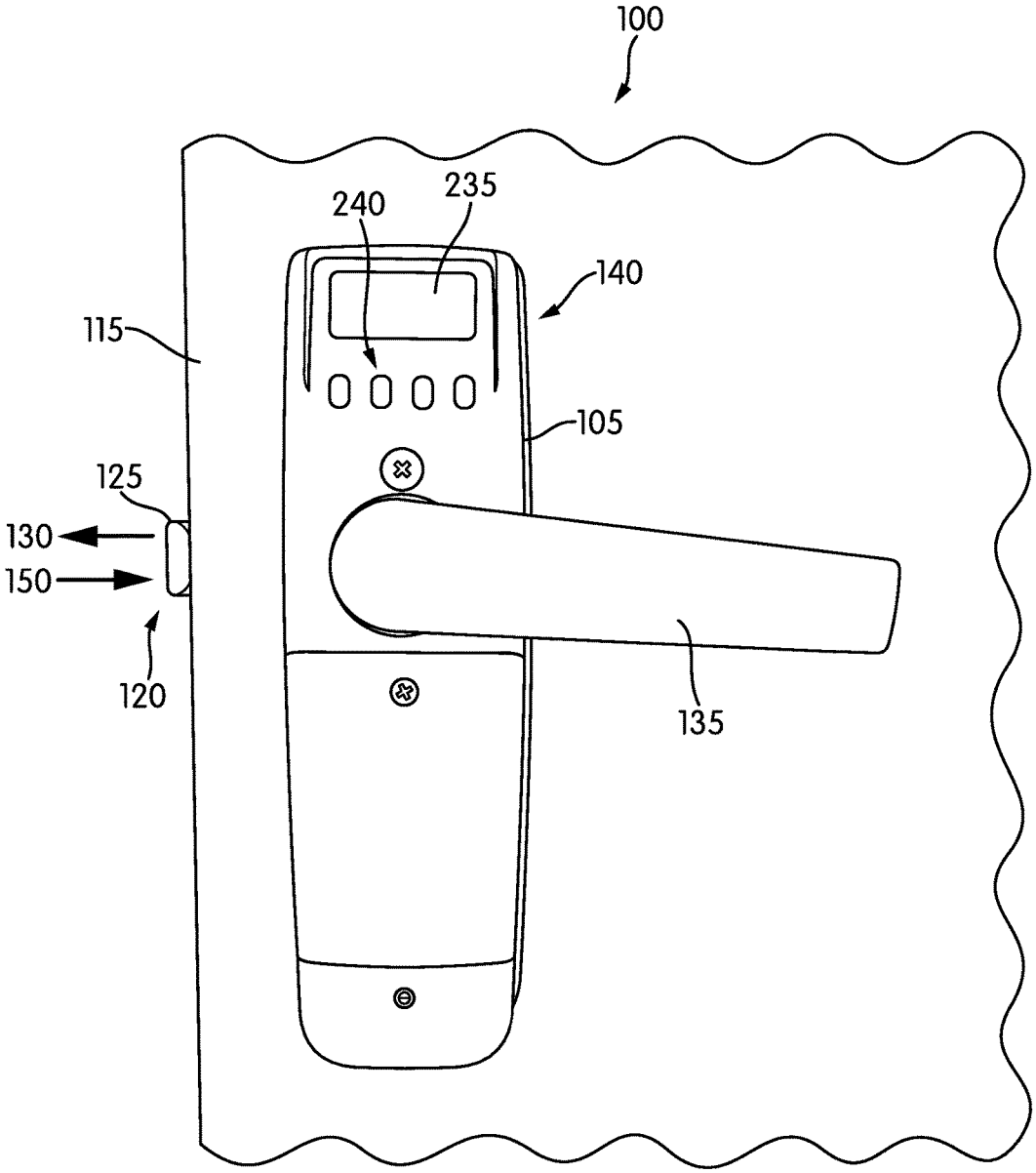
FIG. 3 is a front view of the interior portion of FIG. 1.
Figure 4:
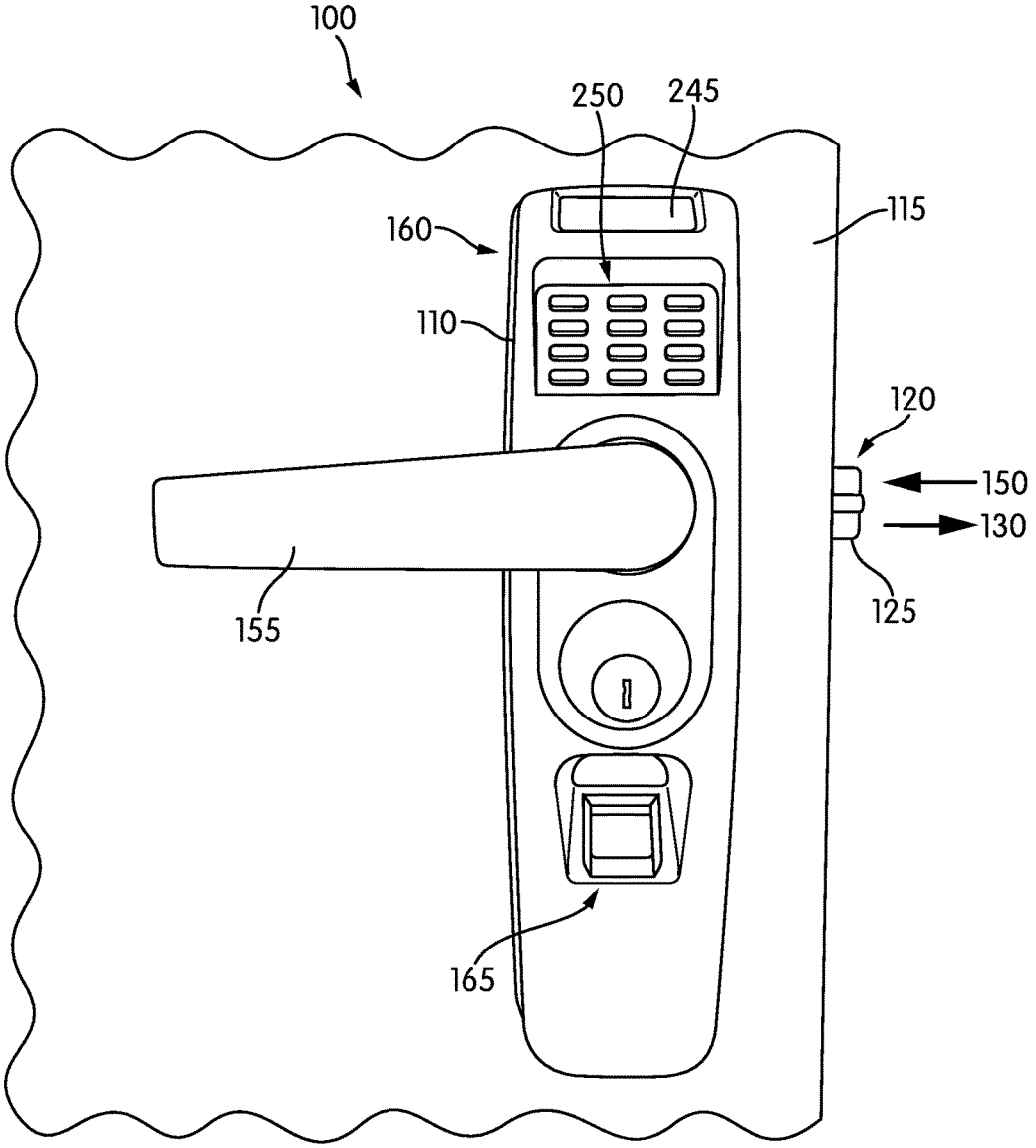
FIG. 4 is a front view of the exterior portion of FIG. 2.
Figure 5:
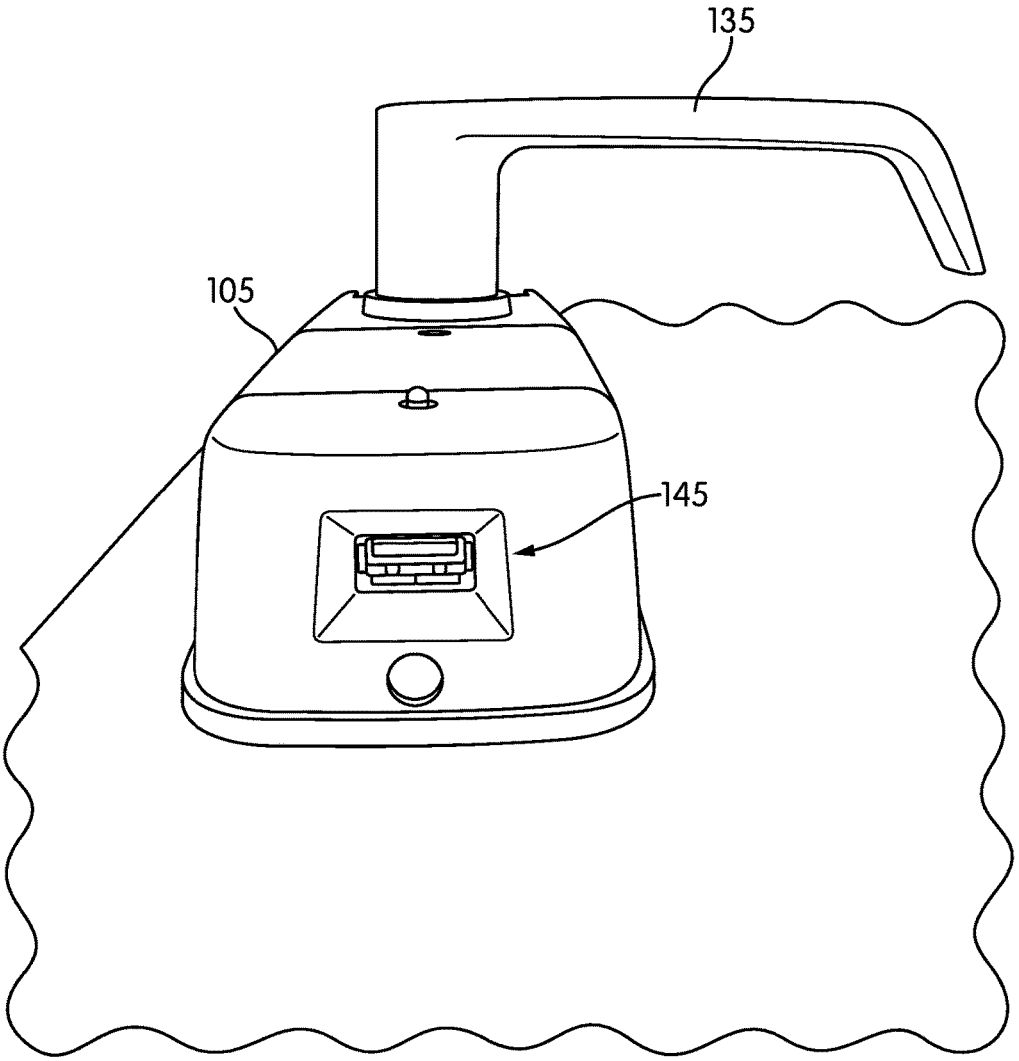
FIG. 5 is a bottom view of the interior portion of FIG. 1 illustrating an input/output according to one embodiment of the invention.

Before embodiments of the present invention are explained in detail, it is to be understood that the invention is not limited in its application to the details of construction and the arrangement of components set forth in the following description or illustrated in the accompanying drawings.

The invention is capable of other embodiments and of being practiced or of being carried out in various ways.

FIGS. 1-5 illustrate an electronic door lock system 100. The electronic lock system 100 includes an interior unit 105 and an exterior unit 110. The electronic lock system 100 is configured to be installed in a variety of doors, such as but not limited to, door 115, which may be an exterior door or an interior door. The interior unit 105 of the electronic door lock system 100 may be installed on the interior of the door 115, while the exterior unit 110 may be installed on the exterior of the door 115. In some embodiments, the lock system 100 may further include a latch 120 assembly. The latch assembly 120 may be a spring-biased latch system, which is known in the art. The illustrated latch assembly 120 includes latch 125, which is biased in a first direction 130. In other embodiments, the lock system 100 may include a deadbolt or other known lock mechanisms.

Figure 6:
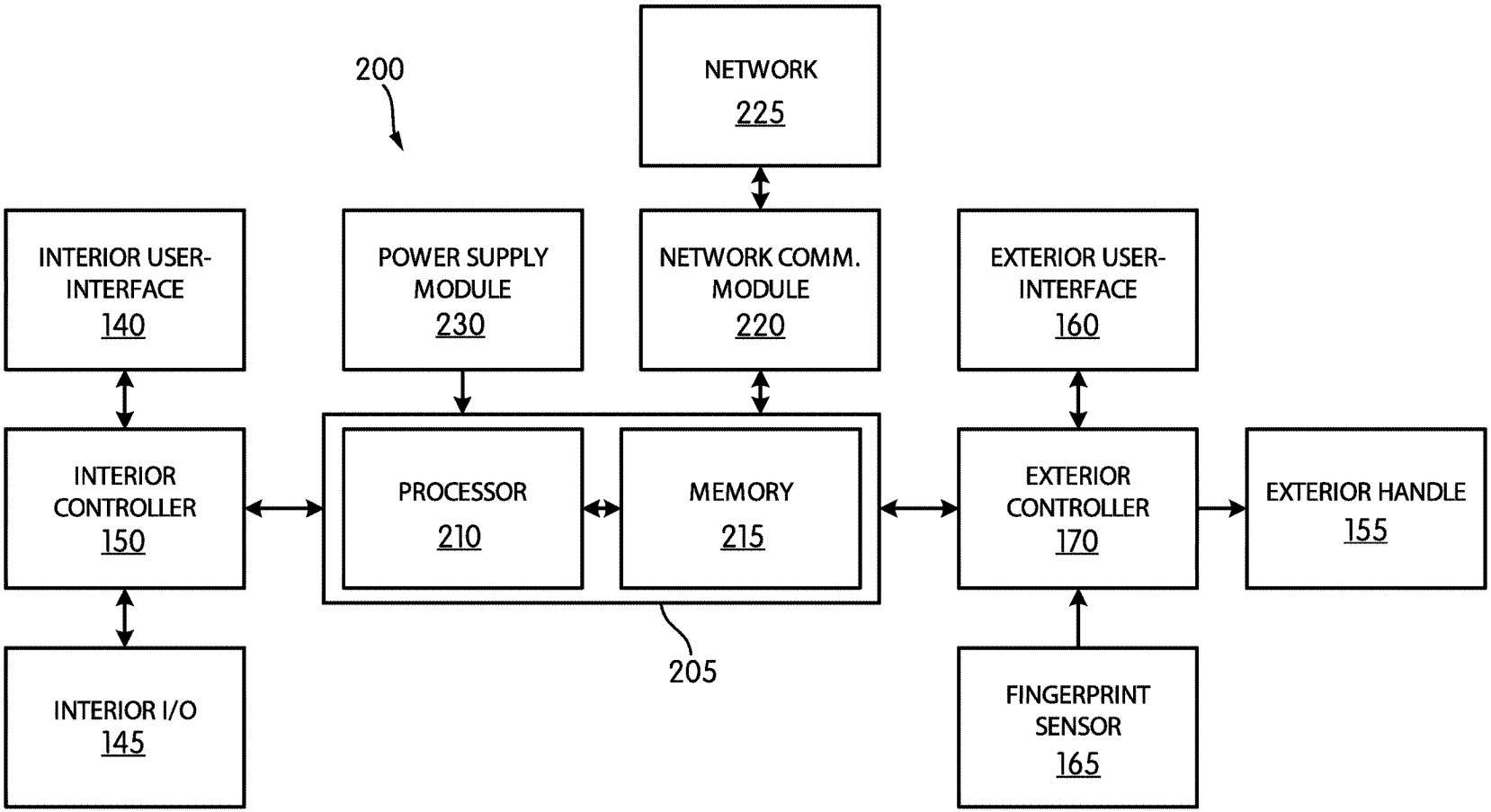
FIG. 6 is a block diagram of a control system of the lock system of FIG. 1.

The interior unit 105 may include an interior handle 135, an interior user interface 140, an interior input/output (I/O) interface 145 (see FIG. 5), and an interior controller 150 (see FIG. 6). Although illustrated as a lever, in other embodiments the interior handle 135 may be a knob or other known door handle. When operated by a user, the interior handle 135 will cause the latch 125 to move in a second direction 150, thus allowing opening of the door 115.

The exterior unit 110 may include an exterior handle 155, an exterior user interface 160, a fingerprint sensor 165, and an exterior controller 170 (FIG. 6). Although illustrated as a lever, in other embodiments the exterior handle 155 may be a knob or other known door handle. In some embodiments, the exterior handle 155 is in a non-active mode in which actuation of the exterior handle 155 will not cause movement of the latch 125. However, when in an active mode and actuated by a user, the exterior handle 155 will cause the latch 125 to move in the second direction 150, thus allowing opening of the door 115.

FIG. 6 illustrates a block diagram of a control system 200 of the electronic lock system 100. The control system 200 includes a main controller 205. The main controller 205 is electrically and/or communicatively connected to a variety of modules or components of the lock system 100, including, among other things, the interior controller 150 and the exterior controller 170. The main controller 205 can include any combination of hardware and software operable to, among other things, control operation of the lock system 100.

In some embodiments, the main controller 205 includes a plurality of electrical and electronic components that provide power, operational control, and protection to the components and modules within the main controller 205 and/or lock system 100. For example, the main controller 205 includes, among other things, a processing unit, or processor 210 (e.g., a microprocessor, a microcontroller, or another suitable programmable device) and a memory 215. In some embodiments, the processor 210 and the memory 215, as well as the various modules connected to the main controller 205 are connected by one or more control and/or data buses. The use of one or more control and/or data buses for the interconnection between and communication among the various modules and components would be known to a person skilled in the art in view of the invention described herein. In some embodiments, the main controller 205 is implemented partially or entirely on a semiconductor (e.g., a field-programmable gate array ["FPGA"] semiconductor) chip, such as a chip developed through a register transfer level ("RTL") design process.

The memory 215 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. In the illustrated embodiment, the processor 210 is connected to the memory 215 and executes software instructions that are capable of being stored in a RAM of the memory 215 (e.g., during execution), a ROM of the memory 215 (e.g., on a generally permanent basis), or another non-transitory computer readable medium such as another memory. Software included in the implementation of the lock system 100 can be stored in the memory 215 of the main controller 205. The software can include, for example, firmware, one or more applications, program data, filters, rules, one or more program modules, and other executable instructions. The main controller 205 of the illustrated embodiment is configured to retrieve from memory and execute, among other things, instructions related to the control processes and methods described herein. In other constructions, the main controller 205 includes additional, fewer, or different components.

The main controller 205 may be further communicatively coupled to a network communications module 220. In some embodiments, the network communications module 220 is configured to connect to and communicate through a network 225. In such embodiments, the network 225 can be configured to connect a plurality of lock systems 100 together. In other embodiments, the plurality of lock systems 100 connect and communicate with each other via respective individual network communications modules 220 (i.e., one for each lock system 100). As discussed in further detail below, in such embodiments, the plurality of lock systems 100 creates a mesh network.

In some embodiments, the network 225 is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 225 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, Z-Wave, etc. Communications through the network 225 by the network communications module 220 or the main controller 205 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), and the like. The connections between the network communications module 220 and the network 225 are, for example, wired connections, wireless connections, or a combination of wireless and wired connections. Similarly, the connections between the main controller 205 and the network 225 or the network communications module 220 are wired connections, wireless connections, or a combination of wireless and wired connections.

The lock system 100 and/or the main controller 205 receive electrical power from a power supply module 230. The power supply module 230 supplies a nominal DC voltage to the main controller 205 and other components or modules of the lock system 100. The power supply module 230 can also be configured to supply lower voltages to operate circuits and components within the main controller 205 or lock system 100. The power supply module 230 is powered by, for example, one or more batteries or battery packs. In other embodiments, the power supply module 230 is powered by a capacitor, such as a super capacitor or a plurality of capacitors electrically connected in series and/or parallel. Also, in other embodiments, the power supply module 230 is powered by a power source having nominal line voltages between 100V and 240V AC and frequencies of approximately 50-60 Hz. In still other embodiments, the power supply module 230 is powered by Power over Ethernet (PoE), such as but not limited to, PoE 802.3.

In some embodiments, the interior controller 150 and/or the main controller 205 may monitor an electrical characteristic of the power supply. The interior controller 150 and/or the main controller 205 may monitor the voltage, current, and temperature of the batteries or battery pack of the lock system 100. In such embodiments, the electrical characteristic can be used to determine a remaining battery life. The interior controller 150 and/or main controller 205 may also or instead monitor the nominal line voltage, or input voltage, of the power supply and determine if the power supply has been interrupted.

In some embodiments, the power supply module 230 receives power from a first power source (e.g., wired AC power supply, PoE, etc.), but additionally includes an uninterruptable power supply ("UPS"). In such embodiments, the first power source continually recharges the UPS, and if the first power source is interrupted, the UPS powers the main controller 205 and various components and modules of the lock system 100. The UPS may be, but is not limited to, one or more batteries, battery packs, or capacitors.

As discussed above, the main controller 205 is communicatively coupled to the interior controller 150. The interior controller 150 can be substantially similar to the main controller 205, and can include similar components. The interior controller 150 is further communicatively coupled to the interior user-interface 140 and the interior I/O interface 145. The interior user-interface 140 may include an interior display 235 and an interior keypad 240. In some embodiments, the interior display 235 is an organic light-emitting diode ("OLED") screen. In other embodiments, the interior display 235 may be, among other things, a liquid crystal display ("LCD"), a light-emitting diode ("LED") display, an electroluminescent display ("ELD"), a surface-conduction electron-emitter display ("SED"), a field emission display ("FED"), and a thin-film transistor ("TFT") LCD. Although illustrated as only having four keys, the interior keypad 240 may have less or more keys. In other embodiments, the interior user-interface 140 may further include one or more additional indicators, such as but not limited to, speakers.

The interior I/O interface 145 inputs and outputs data to an external device. The interior I/O interface 145 is located on the interior of the door 115 to prevent use from the exterior. In some embodiments, the interior I/O interface 145 is a universal serial bus ("USB"). In other embodiments, the interior I/O interface 145 may be, among other things, Ethernet, serial advanced technology attachment ["SATA"], and integrated drive electronics ["IDE"] interfaces.

As discussed above, the main controller 205 is communicatively coupled to the exterior controller 170. The exterior controller 170 can be substantially similar to the main controller 205, and can include similar components. The exterior controller 170 is further communicatively coupled to the exterior handle 155, the exterior user-interface 160, and the fingerprint sensor 165. The exterior user-interface 160 may include an exterior display 245 and an exterior keypad 250. In some embodiment, the exterior display 245 is an organic light-emitting diode ("OLED") screen. In other embodiments, the exterior display 245 may be, among other things, a liquid crystal display ("LCD"), a light-emitting diode ("LED") display, an electroluminescent display ("ELD"), a surface-conduction electron-emitter display ("SED"), a field emission display ("FED"), and a thin-film transistor ("TFT") LCD. In the illustrated embodiment, the exterior keypad 250 is a numeral keypad, however, in other embodiments, the exterior keypad 250 may include more or less keys. Also, in other embodiments, the exterior user-interface 160 may further include one or more additional indicators, such as but not limited to, speakers.

The electronic lock system 100 having an interior user-interface 140 and an exterior user-interface 160 results in a plurality of benefits, including, but not limited to, simplicity of use and safety. The electronic lock system 100 is simpler than previously known lock system because a user does not have to do all the programming from the outside or the inside. Additionally, the electronic lock system 100 adds a safety component, in that the interior user-interface 140 must be used to add/remove users.

Figure 7:
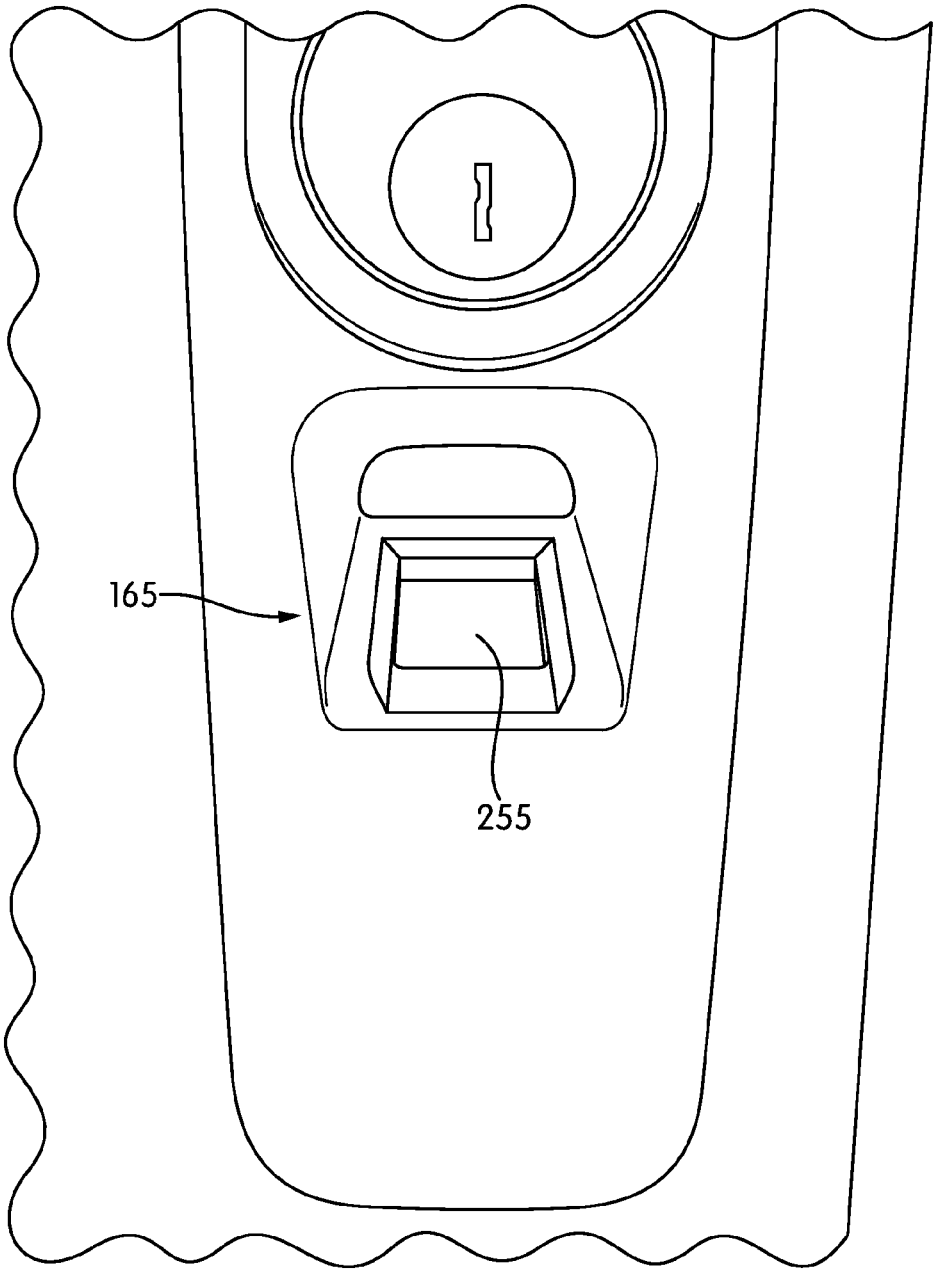
FIG. 7 is a front view of the exterior portion of FIG. 2 illustrating a fingerprint sensor according to one embodiment of the invention.

FIG. 7 illustrates the fingerprint sensor 165. The fingerprint sensor 165 is a fingerprint recognition, or fingerprint authentication, device for sensing and recognizing, or authenticating, one or more fingerprints (e.g., the user's fingerprint). In the illustrated embodiment, the fingerprint sensor 165 is an optical sensor, and includes a touch surface 255. The illustrated fingerprint sensor 165 captures a digital image of the fingerprint placed at the touch surface 255. Beneath the touch surface 255 is a light-emitting phosphor layer which illuminates the surface of the finger. The light reflected from the finger passes through the phosphor layer to an array of solid state pixels (a charge-coupled device) which captures a visual image of the fingerprint. The visual image of the fingerprint is then sent to the exterior controller 170 and/or the main controller 205 for analysis. In other embodiments, the fingerprint sensor 165 may be, but is not limited to, an ultrasonic sensor, a resistive sensor, or a capacitance sensor.

Figure 8:
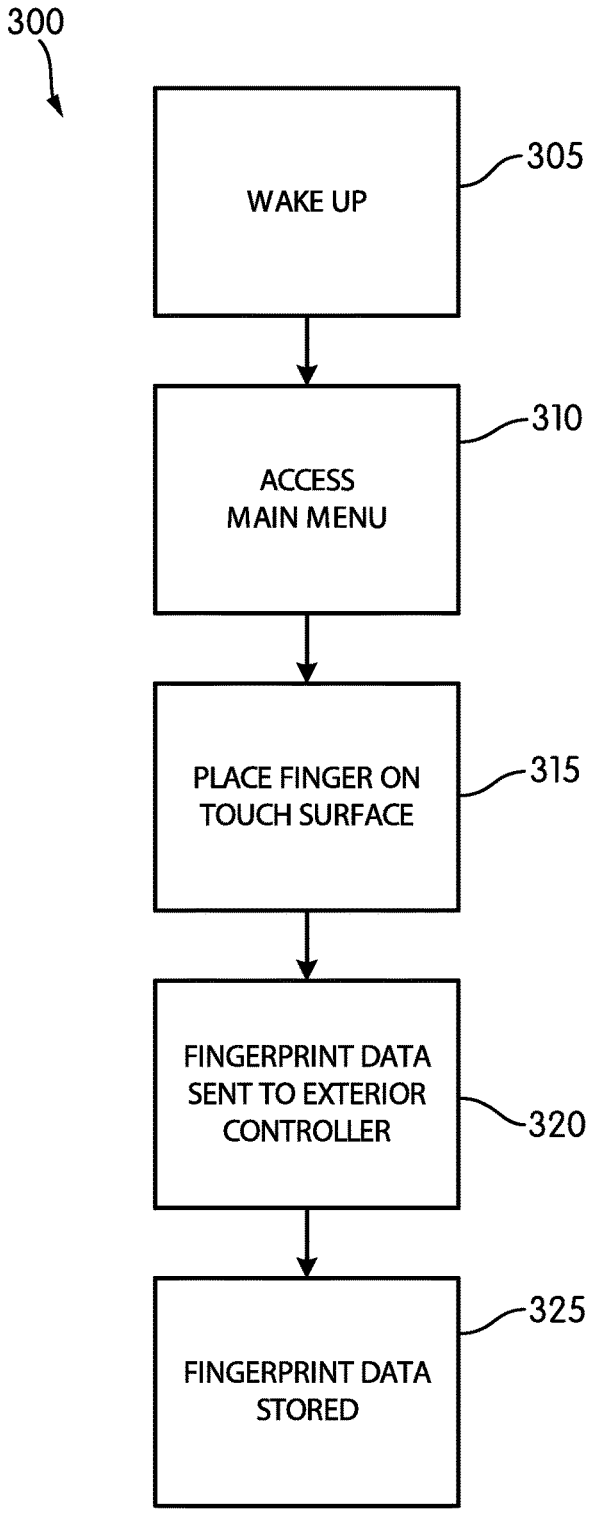
FIG. 8 is a flowchart illustrating an operation of the lock system of FIG. 1.

FIG. 8 illustrates one embodiment of operation 300 of the electronic door lock system 100, in which a user stores individual fingerprint data. Although illustrated as occurring in a sequential order, it should be understood that the order of the steps disclosed in operation 300 may vary. Furthermore, additional steps may be included in the operation 300, and not all of the steps may be required. Operation 300 begins with the user turning on, or waking up, the lock system 100 by pressing a key of keypad 240 (Step 305). The user then accesses a main menu on one of the interior user-interface 140 or exterior user-interface 160 (Step 310). In some embodiments, the main menu is accessed via an administrator password entered via one of the interior keypad 240 or exterior keypad 250. Once the user has accessed the main menu, the user must program his or her fingerprint data. This is performed by placing the user's finger onto the touch surface 255 when prompted by one of the interior display 235 and the exterior display 245 (Step 315). In some embodiments, the lock system 100 may prompt the user to place his or her finger onto the touch surface 255 a plurality of times and/or in a plurality of finger positions. The fingerprint data is sent from the fingerprint sensor 165 to the exterior controller 170 (Step 320), which stores the fingerprint data (Step 325). Alternatively, or in conjunction to Step 325, the exterior controller 170 may send the fingerprint data to the main controller 205 for storage.

Figure 9:
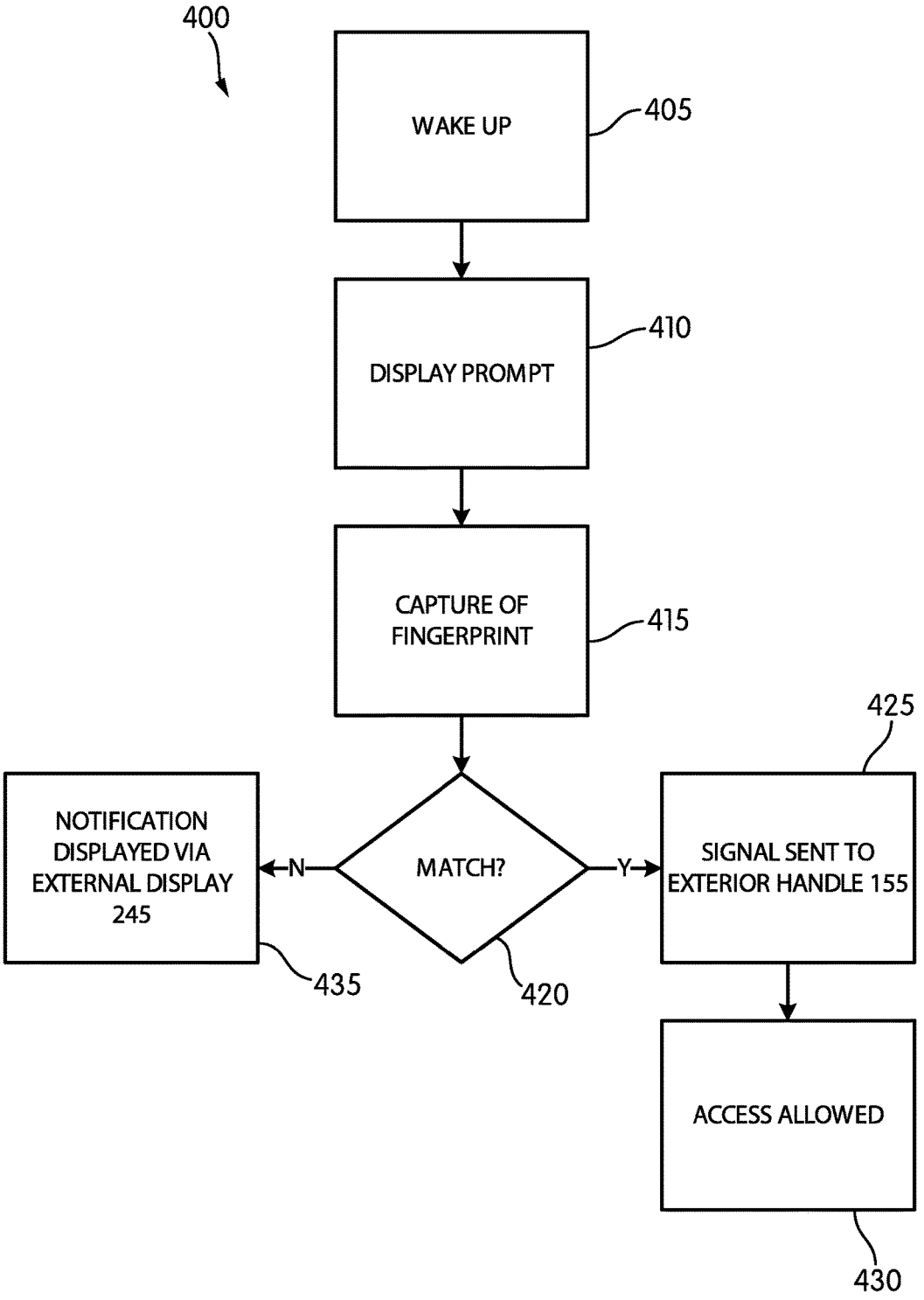
FIG. 9 is a flowchart illustrating another operation of the lock system of FIG. 1.

FIG. 9 illustrates another embodiment of operation 400, in which a user operates the lock system 100 using the fingerprint sensor 165. Although illustrated as occurring in a sequential order, it should be understood that the order of the steps disclosed in operation 400 may vary. Furthermore, additional steps may be included in the operation 400, and not all of the steps may be required. Operation 400 begins with the user waking up the lock system 100 by pressing a key of keypad 250 (Step 405). The exterior display 245 prompts the user to place his or her finger on the touch surface 255 (Step 410). The fingerprint sensor 165 captures the visual image of the fingerprint and sends the visual image to the exterior controller 170 as fingerprint data (Step 415). The exterior controller 170 communicates with the main controller 205 to determine if the fingerprint data matches any stored finger print data (Step 420). If the fingerprint data does match stored fingerprint data, the exterior controller 170 receives an active signal from the main controller 205 and activates the exterior handle 155 (Step 425). The user may then operate the exterior handle 155 to gain access through the door 115 (Step 430). If the fingerprint data does not match any stored fingerprint data in Step 420 (or in some embodiments matches fingerprint data of users who are not authorized), then the exterior controller 170 sends a signal to the exterior display 245 notifying the user (Step 435). In other embodiments discussed in more detail below, after determining that the fingerprint data matched stored fingerprint data, the main controller 205 and/or exterior controller 170 may further determine if the user is allowed access at that specific time of day, based on a use-schedule.

Figure 10:
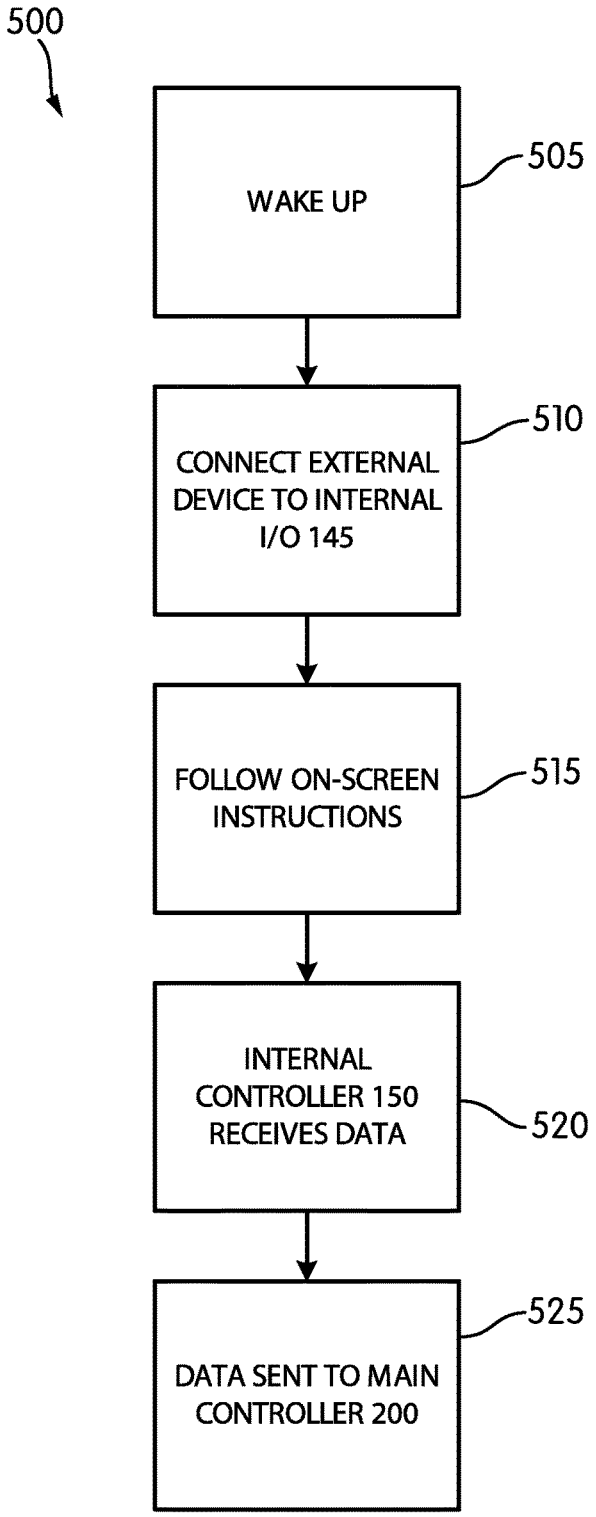
FIG. 10 is a flowchart illustrating another operation of the lock system of FIG. 1.

FIG. 10 illustrates another embodiment of operation 500, in which a user stores fingerprint data and/or use-schedules for a plurality of users. Although illustrated as occurring in a sequential order, it should be understood that the order of the steps disclosed in operation 500 may vary. Furthermore, additional steps may be included in the operation 500, and not all of the steps may be required. Use-schedules may include a plurality of access times for a plurality of users. By way of example only, a use-schedule may include specific times of day, specific days, and/or specific dates in which individual users are allowed access.

Operation 500 begins with the user turning on, or waking up, the lock system 100 by pressing a key of keypad 240 or keypad 250 (Step 505). The user then connects an external device (e.g., a USB memory stick, an external computing device, etc.) to the interior controller 150 via the interior I/O interface 145 (Step 510). The user follows on-screen instructions on either the interior display 235 or the exterior display 245 (Step 515). The fingerprint data and/or use-schedules are received by the interior controller 150 via the interior I/O interface 145 (Step 520). The fingerprint data and/or use-schedules are then sent to the main controller 205 (Step 525).

Figure 11:
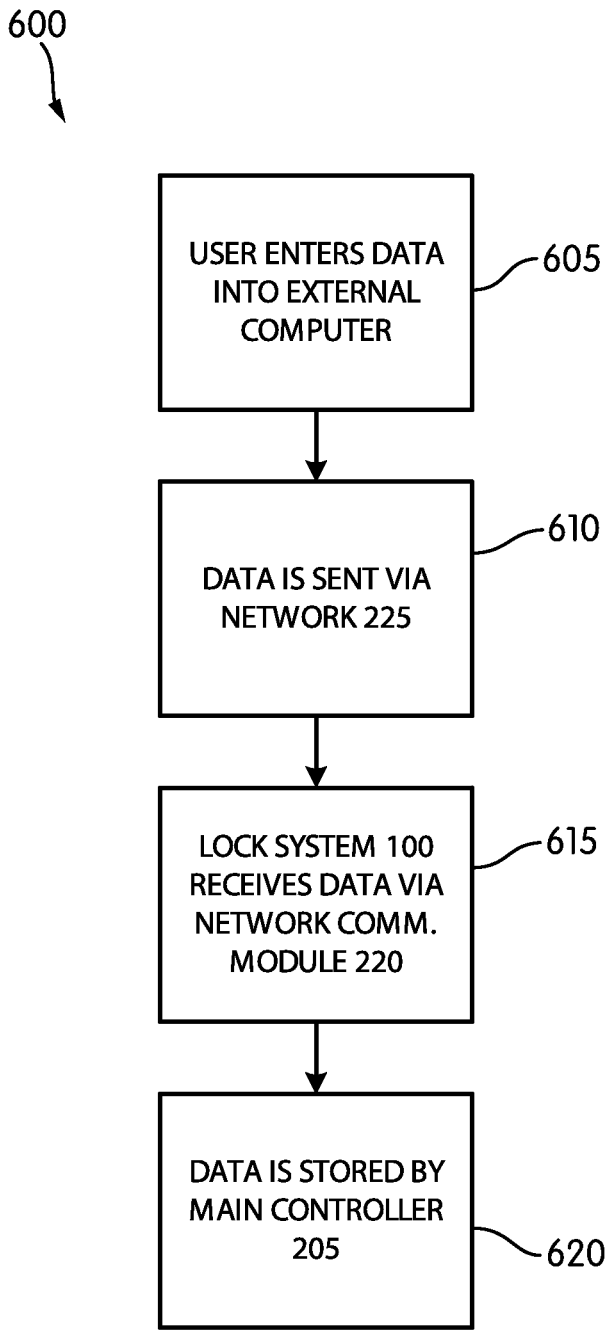
FIG. 11 is a flowchart illustrating another operation of the lock system of FIG. 1.

FIG. 11 illustrates another embodiment of operation 600, in which the lock system 100 receives fingerprint data and/or use-schedules via the network communications module 220. Although illustrated as occurring in a sequential order, it should be understood that the order of the steps disclosed in operation 600 may vary. Furthermore, additional steps may be included in the operation 600, and not all of the steps may be required. Operation 600 begins with a user entering fingerprint data and/or use-schedules at an external computer (Step 605). The user then sends the fingerprint data and/or use-schedules to the lock system 100 via the network 225 (Step 610). As discussed above, in some embodiments, the network 225 may include be a mesh network (e.g., a wireless mesh network, such as but not limited to a wireless network using a Z-Wave communications protocol), which includes a plurality of other lock systems 100. In such embodiments, the network 225 may use an algorithm to determine the best path for transmitting the data (e.g., fingerprint data, use-schedules, etc.) between the lock systems in order to achieve faster communication, and/or conserve battery life of the individual lock systems 100. In some embodiments, the algorithm is based at least in part upon the physical distance each individual lock system is away from one or more other lock systems 100 in the network. The algorithm may also or instead be based at least in part upon the remaining battery life of each individual lock system, which information is provided from individual lock systems 100 across the network as needed. In some embodiments, the algorithm is based at least in part upon both the physical distances between lock systems 100 in the network and the remaining battery lives of each of the lock systems 100. The individual lock system 100 receives the fingerprint data and/or the use-schedules via the network communications module 220 (Step 615). The fingerprint data and/or use-schedules are stored by the main controller 205 (Step 620).

Figure 12:
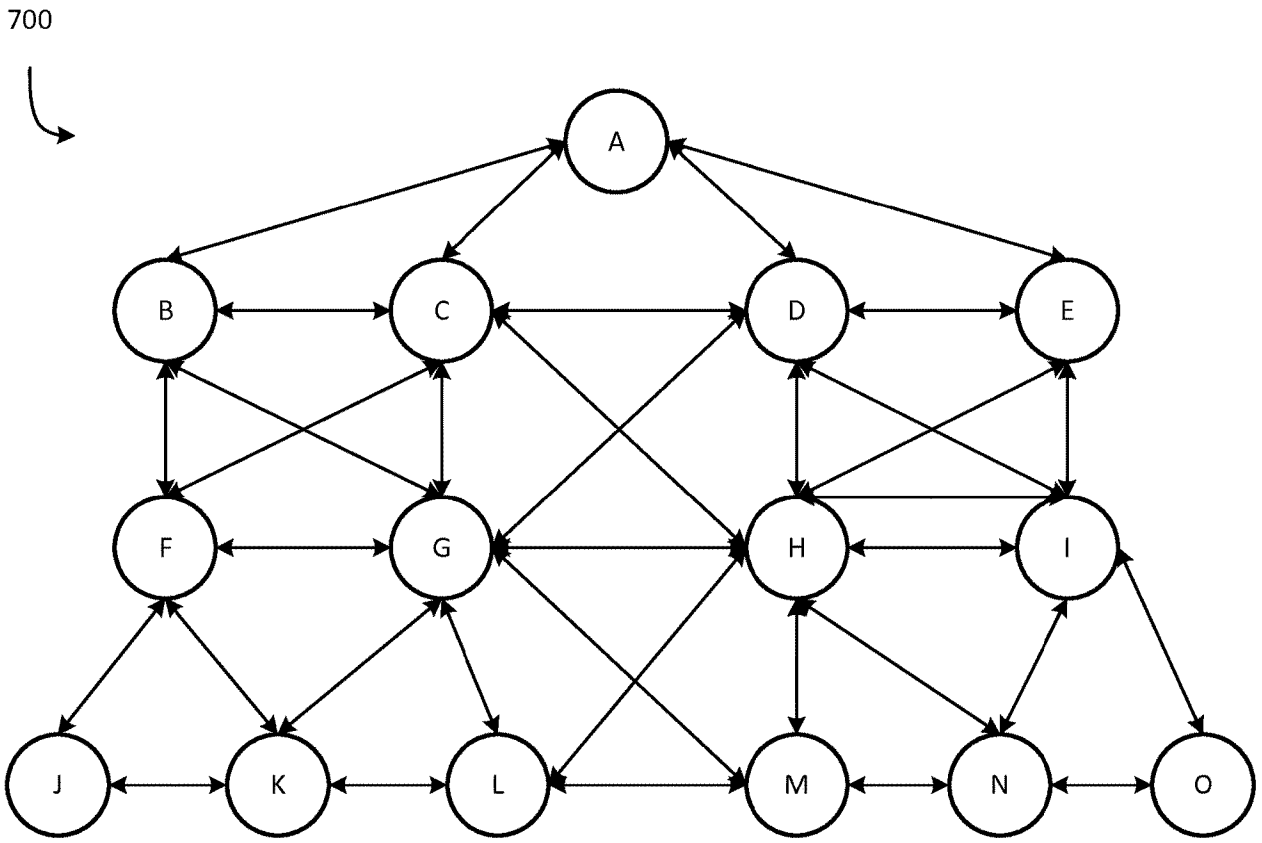
FIG. 12 one embodiment of a mesh network of a plurality of lock systems of FIG. 1.

FIG. 12 illustrates one embodiment of a mesh network 700. The mesh network 700 includes a plurality of nodes A-O. In some embodiments, each of the plurality of nodes A-O is an individual lock system 100 described and illustrated herein. In other embodiments, the plurality of nodes A-O include one or more external computing devices and one or more individual lock systems 100 described and illustrated herein. The plurality of nodes A-O is configured to communicate with each other through the mesh network 700. By way of example only and with reference to FIG. 12, node A is configured to communicate with node K; node L is configured to communicate with node H; etc. In some embodiments, the communication path between nodes is determined using signal strength, which is indicative of distances between nodes. In these and other embodiments, the communication path between nodes is determined using signal strength and an error rate of a test signal sent between nodes. In such embodiments, the signal strength along with the error rate of a test signal are used to determine a wireless transmission efficiency between nodes. Typically, a higher error rate means more drain on a battery of an individual lock system 100 during wireless communication. Therefore, in some embodiments, although a first communication path may be physically shorter than a second communication path, the second communication path may have a lower error rate. Thus, efficiency may determine that the second communication path will be used.

By determining the communication path using signal strength and/or the efficiency between nodes, battery life of the individual lock systems 100 is increased. In some embodiments, battery life of the individual lock systems 100 is monitored. In such embodiments, if the remaining battery life of an individual lock system 100 is below a threshold, the individual lock system 100 will not be used for communication within the mesh network 700.

Figure 13:
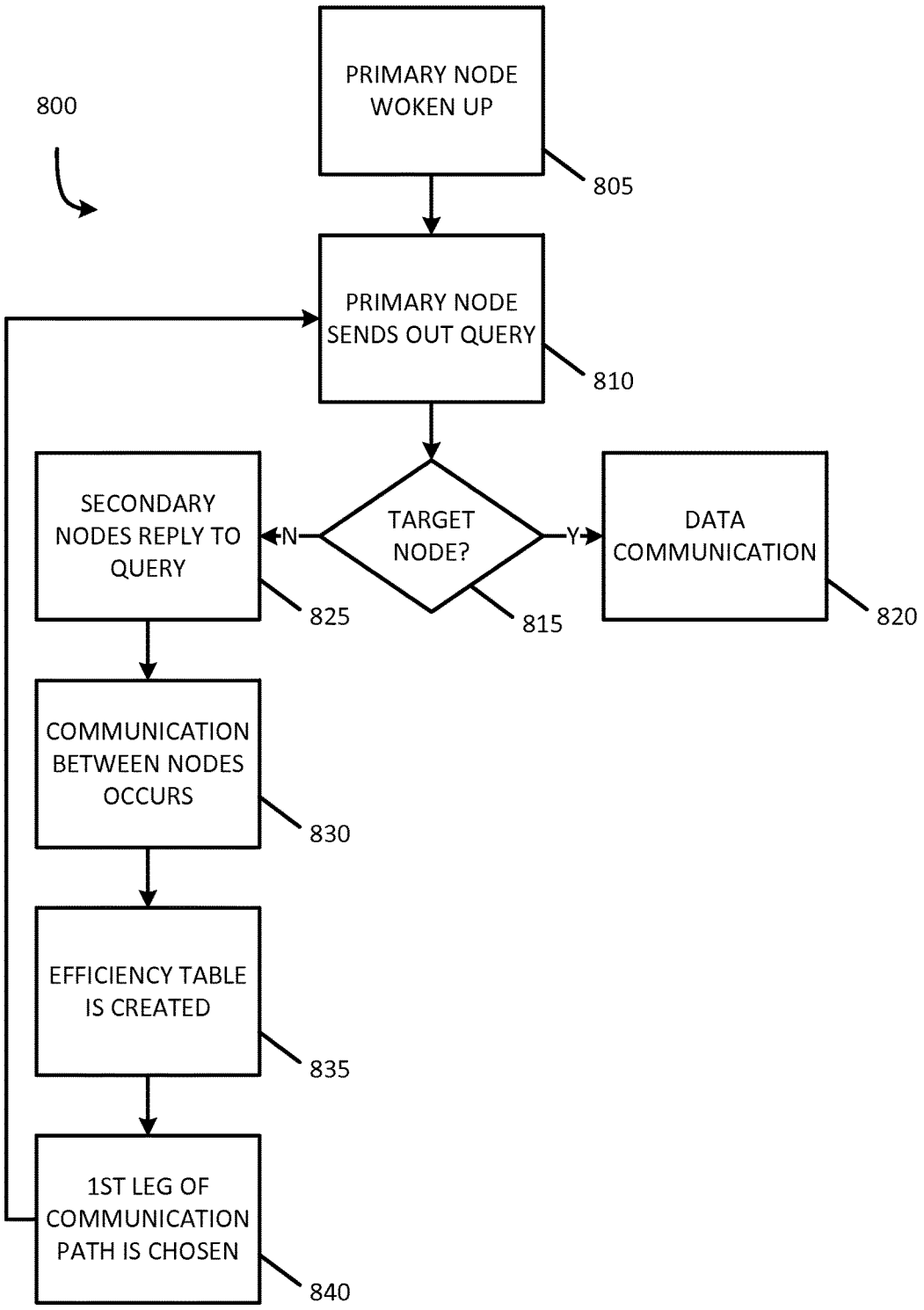
FIG. 13 illustrates a process, or communication protocol, for determining a communication path between nodes of the mesh network of FIG. 12.

FIG. 13 illustrates a process 800, or communication protocol, for determining a communication path between nodes of the mesh network 700. Although illustrated as occurring in a sequential order, it should be understood that the order of the steps disclosed in operation 800 may vary. Furthermore, additional steps may be included in the operation 800, and not all of the steps may be required in some embodiments. In some embodiments, all of the nodes typically operate in a "sleep mode" until they are awoken by a user or by another node. The process 800 begins by a user waking a primary node (e.g., node A) (Step 805). The primary node sends out a query to a plurality of secondary nodes within range (e.g., node B, node C, node D, node E of FIG. 12) (see Step 810 of FIG. 13). The secondary nodes wake up and reply to the primary node with an identification number or other data. The reply with the identification number allows the primary node to know what nodes exist within range of the primary node. The process 800 determines if the target node is within range (Step 815). If the target node is in range, data communication occurs between the primary node and the target node (Step 825). If the target node is not in range, a communication is performed between the primary node and the secondary nodes to determine signal strengths (and/or in some embodiments, error rates) of each second node (Step 830). The primary node creates a table or other aggregation or listing of data of identification numbers of the secondary nodes with the respective signal strengths and/or error rates (e.g., efficiency between nodes) (Step 835). A leg of the communication path is then chosen based at least in part upon the efficiency between the primary node and secondary nodes (Step 840). Once a secondary node is chosen based at least in part upon efficiency, and thus a first leg of the communication path is chosen, the process returns to Step 810, and the chosen secondary node becomes the primary node.

In other embodiments, the primary node outputs a query to a plurality of secondary nodes within range. The secondary nodes then output queries to a plurality of tertiary nodes within range. This occurs until all of the nodes are queried and reply back with respective identification numbers or other identification data. Communication through the mesh network is then performed between the primary node and the secondary nodes, tertiary nodes, etc., in order to determine the respective signal strengths and/or error rates as described above. A complete efficiency table (or other aggregation of this data) is then created for all of the nodes within the mesh network. The communication path between the primary node and the target node is then chosen using the complete efficiency table.

Figure 14:
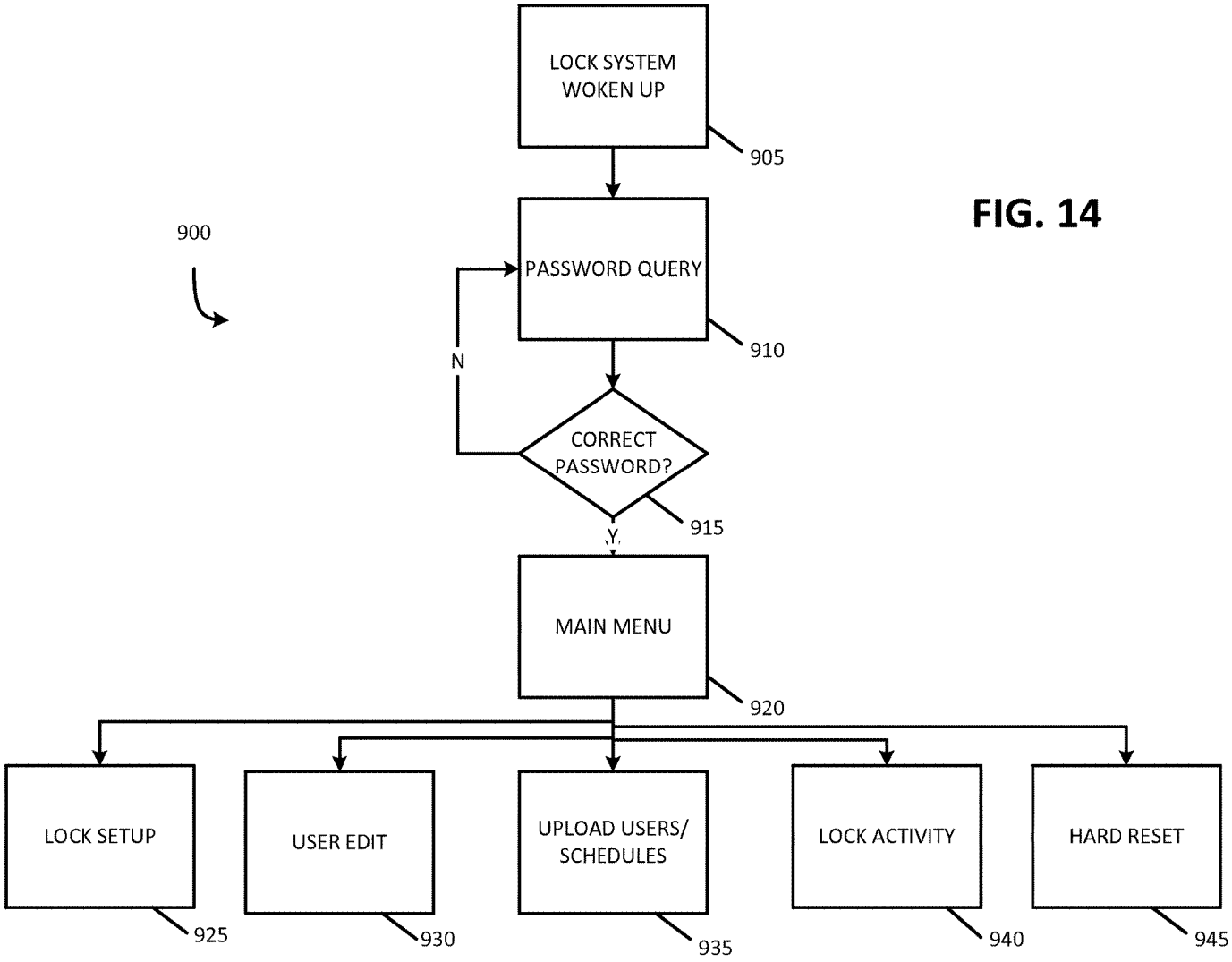
FIG. 14 illustrates a software decision tree the lock system of FIG. 1.

FIG. 14 illustrates an exemplary embodiment of a software decision tree 900 for the electronic lock system 100. In this illustrated embodiment, a user wakes up the electronic lock system 100 by activating the interior user-interface 140 or the exterior user-interface 160 (box 905). The electronic lock system 100 queries the user for a password and/or fingerprint data (box 910). The electronic lock system 100 determines if the password and/or fingerprint data is correct (box 915). If the password and/or fingerprint data is incorrect, an error message is displayed, and the software returns to Box 910. If the password and/or fingerprint data is correct, the MAIN MENU is displayed (Box 920). The user can then select a plurality of options from the MAIN MENU, including but not limited to, LOCK SETUP (box 925), USER EDIT (box 930), UPLOAD USERS/SCHEDULES (Box 935), LOCK ACTIVITY (Box 940), and HARD RESET (Box 945). The LOCK SETUP (Box 925) allows the user to set up the lock (e.g., set the date and time of the lock, sensitivity of the fingerprint sensor 165, brightness of interior display 235, brightness of exterior display 245, etc.). The USER EDIT (Box 930) allows the user to add, delete, and modify user information (e.g., user passwords, user fingerprint data, user schedules, etc.) of the electronic lock system 100. The UPLOAD USERS/SCHEDULES (Box 935) allows a user to upload a plurality of user information (e.g., user passwords, user fingerprint data, user schedules, etc.) as discussed above in more detail. The LOCK ACTIVITY (Box 940) allows the user to view and/or download the activity of the electronic lock system 100 (e.g., activation dates/times of the electronic lock system 100, usage occurrences, use dates and time, use dates and time of particular users, and the like). The HARD RESET (Box 945) resets the electronic lock system 100.

In some embodiments, the lock system 100 only includes the main controller 205, and not an interior controller 150 and/or an exterior controller 170. In such embodiments, the main controller 205 may perform the functions of the internal controller 150 and/or the exterior controller 170 mentioned above. In some embodiments, the lock system 100 includes main controller 205, interior controller 150, and the exterior controller 170, and at least two of the three controllers are part of a common controller, which performs all of the functions described above of at least two of the three controllers.

Thus, some embodiments of the invention provide, among other things, an electronic lock system having a fingerprint sensor, mesh network capability, and a wireless power supply. Various features and advantages of the invention are set forth in the following claims.

What is claimed is:

1. An electronic door lock system comprising:

a latch having a latched position and an unlatched position;

an interior unit configured to be installed on an interior side of a door, the interior unit including an interior handle operable to place the latch in the unlatched position, an interior user-interface, and an interior controller communicatively coupled to the interior user-interface;

an exterior unit configured to be installed on an exterior side of a door opposite the interior side of the door, the exterior unit including an exterior handle having an active mode and a non-active mode, the exterior handle operable to place the latch in the unlatched position when in the active mode, an exterior user-interface, a fingerprint sensor configured to sense fingerprint data, and an exterior controller configure to, receive the sensed fingerprint data, output the sensed fingerprint data, and place the exterior handle in the active mode upon receiving an active signal; and a main controller communicatively coupled to the interior controller and the exterior controller, the main controller configured to receive the sensed fingerprint data from the exterior controller, compare the sensed fingerprint data to a known fingerprint data, and output the active signal to the exterior controller based on the comparison.

2. The electronic door lock system of claim 1, wherein the interior controller, the exterior controller, and the main controller, are part of a common controller.

3. The electronic door lock system of claim 1, further including an input/output interface.

4. The electronic door lock system of claim 3, wherein the input/output interface is a universal serial bus.

5. The electronic door lock system of claim 1, wherein the interior user-interface includes an interior display and the exterior user-interface includes an exterior display.

6. The electronic door lock system of claim 5, wherein the interior display and the exterior display are organic light-emitting displays (OLED).

7. The electronic door lock system of claim 1, further including a network communications module communicatively coupled to the main controller.

8. The electronic door lock system of claim 7, wherein the network communications module uses a Z-Wave communications protocol.

9. The electronic door lock system of claim 8, wherein the electronic door lock system wirelessly communicates with a plurality of electronic door lock systems via a mesh network.

10. The electronic door lock system of claim 1, wherein the electronic lock system is configured to be programmed via the interior user-interface.

11. An electronic door lock system comprising:
- a latch having a latched position and an unlatched position;
- an interior unit configured to be installed on an interior side of a door, the interior unit including
- an interior handle operable to place the latch in the unlatched position, and
- an interior user-interface having an interior display,
- an exterior unit configured to be installed on an exterior side of a door opposite the interior side of the door, the exterior unit including
  - an exterior handle having an active mode and a non-active mode, the exterior handle operable to place the latch in the unlatched position when in the active mode,
  - an exterior user-interface having an exterior display, and
  - a fingerprint sensor configured to sense fingerprint data and output the sensed fingerprint data; and
- a main controller communicatively coupled to the interior unit and the exterior unit, the main controller configured to
- receive the sensed fingerprint data,
- compare the sensed fingerprint data to a known fingerprint data, and
- place the exterior handle in the active mode based on the comparison.

12. The electronic door lock system of claim 11, wherein the interior display and the exterior display are organic light-emitting displays (OLED).

13. The electronic door lock system of claim 11, wherein the interior unit further includes an interior controller and the exterior unit further includes an exterior controller, wherein the interior controller and the exterior controller are communicatively coupled to the main controller.

14. The electronic door lock system of claim 13, wherein the exterior controller is configured to,
- receive the sensed fingerprint data, and
- output the sensed fingerprint data to the main controller.

15. An electronic door lock system comprising:
- a latch having a latched position and an unlatched position;
- an interior unit configured to be installed on an interior side of a door, the interior unit including
- an interior handle operable to place the latch in the unlatched position, and
- an interior user-interface having an interior display;
- an exterior unit configured to be installed on an exterior side of a door opposite the interior side of the door, the exterior unit including
  - an exterior handle having an active mode and a non-active mode, the exterior handle operable to place the latch in the unlatched position when in the active mode,
  - an exterior user-interface having an exterior display, and
  - a fingerprint sensor configured to sense fingerprint data and output the sensed fingerprint data;
- a wireless power supply module;
- a wireless network communications module; and
- a main controller communicatively coupled to the interior unit, the exterior unit, the wireless power supply module, and the wireless network communications module, the main controller configured to
- receive the sensed fingerprint data,
- compare the sensed fingerprint data to a known fingerprint data, and
- place the exterior handle in the active mode based on the comparison.

16. The electronic door lock system of claim 15, wherein the wireless network communications module uses a Z-Wave communications protocol.

17. The electronic door lock system of claim 15, wherein the electronic door lock system wirelessly communicates with a second electronic door lock system via the wireless network communication module.

18. The electronic door lock system of claim 15, wherein the wireless power supply module consists of one from the following group, one or more batteries and one or more capacitors.

19. An electronic lock network comprising:
- a plurality of lock systems each including
  - a latch having a latched position and an unlatched position,
  - an interior unit configured to be installed on an interior side of a door, the interior unit including
    - an interior handle operable to place the latch in the unlatched position,
    - an interior user-interface, and
    - an interior controller communicatively coupled to the interior user-interface,
  - an exterior unit configured to be installed on an exterior side of a door opposite the interior side of the door, the exterior unit including
    - an exterior handle having an active mode and a non-active mode, the exterior handle operable to place the latch in the unlatched position when in the active mode,
    - an exterior user interface,
    - a fingerprint sensor configured to sense fingerprint data,
    - an exterior controller configured to,
      - receive the sensed fingerprint data,
      - output the sensed fingerprint data, and
      - place the exterior handle in the active mode upon receiving an active signal,
  - a wireless power supply,
  - a wireless network communications module, and a main controller communicatively coupled to the interior controller, the exterior controller, the wireless power supply and the wireless network communication module, the main controller configured to receive the sensed fingerprint data, compare the sensed fingerprint data to a known fingerprint data, and place the exterior handle in the active mode based on the comparison; and an external computer including a second wireless network communications module, the external computer configured to send the known fingerprint data to at least one of the plurality of lock systems over a wireless mesh network comprising the plurality of lock systems.

20. The electronic lock network of claim 19, wherein the electronic lock network uses an algorithm to determine the fastest path for transmitting the known fingerprint data through the mesh network, the algorithm based on a plurality of distances between the plurality of lock systems.

21. The electronic lock network of claim 19, wherein the electronic lock network uses an algorithm to determine the fastest path for transmitting the known fingerprint data through the mesh network, the algorithm based on an electrical characteristic of the wireless power supplies of the plurality of lock systems.

* * * * *